US006857208B2

(12) United States Patent
Gandhi et al.

(10) Patent No.: US 6,857,208 B2
(45) Date of Patent: Feb. 22, 2005

(54) REBUILDABLE ELEVATOR FLIGHT FOR SCRAPER

(75) Inventors: Smita Gandhi, Peoria, IL (US); Paul J. Lukavich, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/319,787

(22) Filed: Dec. 13, 2002

(65) Prior Publication Data

US 2004/0111926 A1 Jun. 17, 2004

(51) Int. Cl.[7] ..... E02F 3/14; E02F 9/28

(52) U.S. Cl. ..... 37/465

(58) Field of Search ..... 37/422–424, 463–465, 37/373–376, 419, 208, 389, 106, 107

(56) References Cited

U.S. PATENT DOCUMENTS 3,581,415 A 6/1971 Campbell et al.
3,593,439 A 7/1971 Eftefield
3,596,383 A 8/1971 Bispo et al.
3,653,132 A 4/1972 Campbell et al.
3,699,820 A 10/1972 Voth
3,700,383 A 10/1972 Boersma
3,733,964 A 5/1973 Schantz
3,735,509 A 5/1973 Condra
3,748,759 A 7/1973 Liess
3,758,966 A 9/1973 Miller
3,807,063 A 4/1974 Hyler et al.
3,818,618 A 6/1974 Hyler
3,866,742 A 2/1975 Freese et al.
3,872,612 A 3/1975 Gee
3,875,690 A 4/1975 Hancock et al.
3,900,977 A 8/1975 Hyler
3,903,623 A 9/1975 Hyler
3,905,136 A 9/1975 Hyler
3,916,541 A 11/1975 Hood et al.
3,916,545 A 11/1975 Hochmann et al.
3,927,759 A 12/1975 Hyler et al.
3,930,323 A 1/1976 Marold et al.
3,934,360 A 1/1976 Hyler
3,934,362 A 1/1976 Hyler
3,946,619 A 3/1976 Needles et al.
3,946,859 A 3/1976 Jeffrey et al.
3,950,866 A 4/1976 Hyler
3,959,896 A 6/1976 Wagner
3,971,146 A 7/1976 Hyler
3,971,147 A 7/1976 Hyler
3,977,100 A 8/1976 Boersma (List continued on next page.)

OTHER PUBLICATIONS

Caterpillar 623G Elevating Scraper Specifications, brochure No. AEHQ5530, Caterpillar Inc., 20 pages, Aug. 2003.

*Primary Examiner*—Christopher J. Novosad
(74) *Attorney, Agent, or Firm*—Thomas L Derry; Andrew J Ririe

(57) ABSTRACT

The present invention provides a flight assembly for use on a scraper having an elevator. The flight assembly includes a lateral support member having a wear plate attached thereon. A wear cap is provided on each end of the lateral support member. The wear plates and wear caps are preferably bolted to the support member.

25 Claims, 2 Drawing Sheets

U.S. PATENT DOCUMENTS 3,978,597 A 9/1976 Brudnak, Jr.
3,983,762 A 10/1976 Dellner
3,984,927 A 10/1976 Hyler
3,990,160 A 11/1976 Dellner
4,023,285 A 5/1977 Hancock et al.
4,037,334 A 7/1977 Plemitscher
4,044,480 A 8/1977 Stedman
4,053,997 A 10/1977 Stuller et al.
4,071,965 A 2/1978 Lee
4,128,952 A 12/1978 Duke et al.
4,133,122 A 1/1979 Girard et al.
4,159,583 A 7/1979 Black et al.
4,179,024 A 12/1979 Boersma
4,223,460 A 9/1980 Black et al.
4,243,137 A 1/1981 Laurenz
4,286,705 A 9/1981 Boersma
4,294,026 A 10/1981 Welch
4,366,635 A 1/1983 Joyce, Jr.
4,410,076 A * 10/1983 West et al. ..... 193/32
5,207,391 A * 5/1993 Anderson ..... 241/186.4
5,271,167 A 12/1993 Smith
2004/0050453 A1 * 3/2004 Heikkinen ..... 144/373

* cited by examiner 66
54
74
92
66
76
62
66
62
100
84
58
52
102
76
82
78
92
96
74
82
68
72
84
86
90
88
64
56
64

REBUILDABLE ELEVATOR FLIGHT FOR SCRAPER

TECHNICAL FIELD

This invention relates generally to a scraper for moving dirt and earth, and more specifically to a flight assembly for a scraper wherein the flight assembly has replaceable wear elements.

BACKGROUND

Elevating scrapers are used to remove and transport large volumes of earth from one location to another. A cutting edge in the scraper bowl is pulled through the dirt to loosen the dirt. A powered elevator is positioned in the bowl to lift the dirt away from the cutting edge. A plurality of flights are attached to the elevator to engage and lift the dirt. The flights are typically manufactured by welding a variety of formed steel plates together to create a structurally sound weldment. The welded flights require numerous man-hours to fabricate. Over a period of time some portions of the flights become worn and require repair. Typical repairs require building up the worn portions of the flight with weld and then grinding or machining the welded portion to manufacturers specifications.

It would be desirable to have a simply fabricated flight that can be easily repaired. The present invention is directed to overcome the above stated problems.

DETAILED DESCRIPTION

Figure 1:
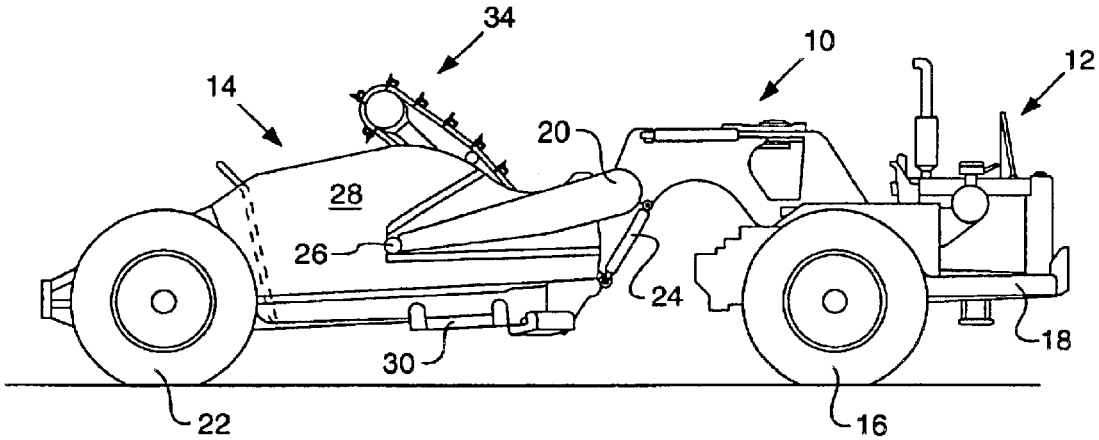
FIG. 1 is a side view of a scraper having an elevator to load dirt.

Referring to FIG. 1, a scraper is generally indicated by reference number 10. The scraper includes a tractor 12 and a bowl 14. The tractor 12 includes a pair of ground engaging wheels 16, a frame 18, and a pair of spaced rearwardly projecting draft arms 20 which pivotally support the bowl 14 relative to the tractor 12. The bowl 14 has a pair of ground engaging wheels 22 which support the bowl 14 on the ground. A pair of hydraulic cylinders 24 which are attached between the frame 18 and the bowl 14 vertically move the bowl 14 to pivot around a pair of pins 26 which attach the draft arms 20 to the bowl 14. The bowl 14 includes a pair of spaced parallel sidewalls 28 and a moveable floor 30 for ejecting material.

Figure 2:
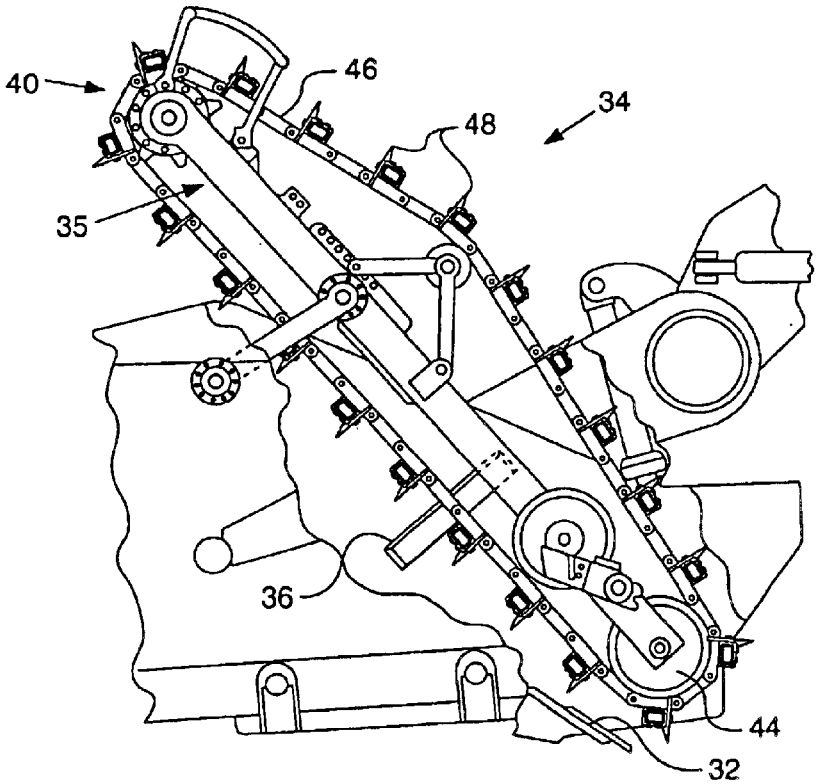
FIG. 2 is an enlarged side view of the scraper having a partial broken section illustrating an elevator positioned in the scraper bowl.

As shown in FIG. 2, a cutting edge 32 is positioned and attached between the sidewalls 28 at the forward opening of the bowl 14. An elevator 34 is positioned between the sidewalls 28 at the forward opening of the bowl 14. The elevator 34 carries dirt from the cutting edge 32 rearwardly and upwardly into the bowl 14. The elevator 34 includes a vertical frame 35 attached to each sidewall 28 by a support linkage 36. The vertical frame 35 includes a first side rail 37 and a second side rail (not shown). A motor 40 with a drive sprocket 42 is attached to the upper end of the frame 35. A guide wheel 44 is attached to the lower end of the frame 35.

Each side rail 37 receives an endless chain 46, positioned around the sprocket 42 and the guide wheel 44. Flight assemblies 48 for carrying material into the bowl 14 are mounted along the chain 46 at essentially equally spaced intervals.

Figure 3:
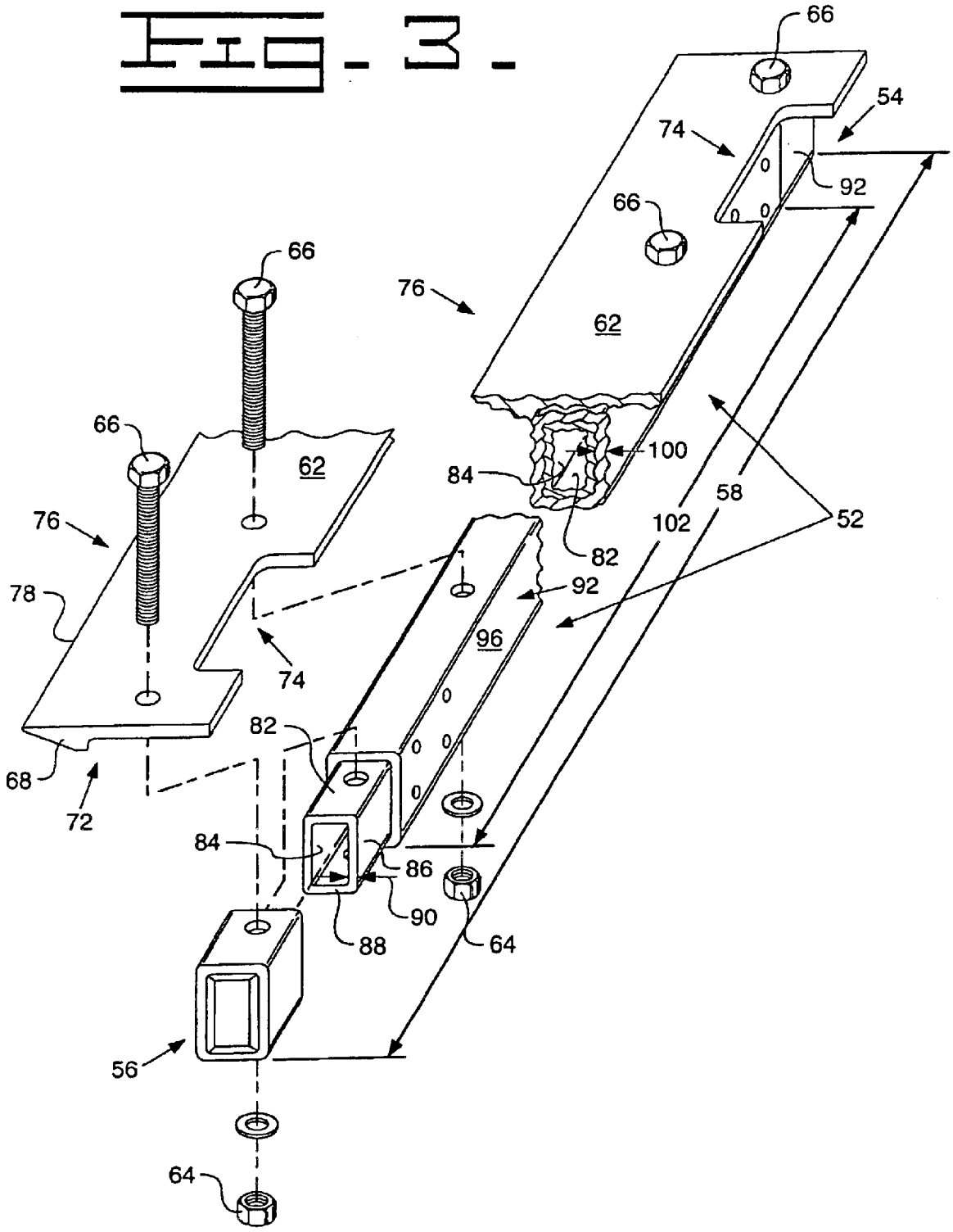
FIG. 3 is a perspective view of the elevator flight of the present invention, the front-most portion showing an exploded view and the rearmost portion showing an assembled view.
Figure 1:
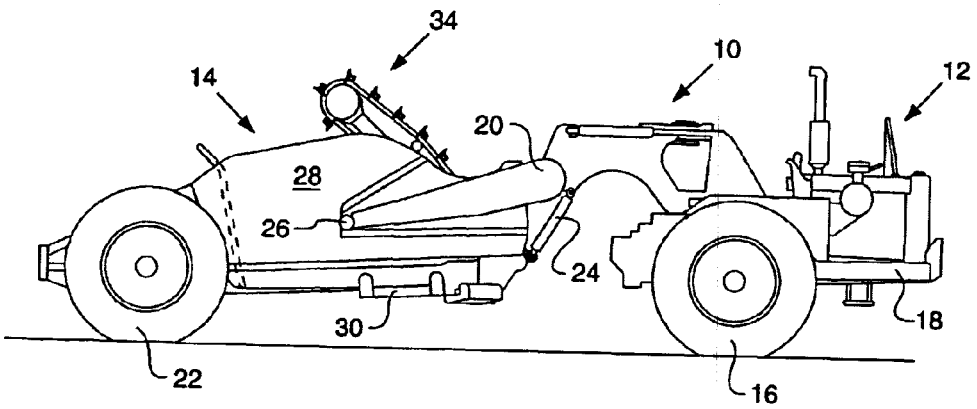
Figure 2:
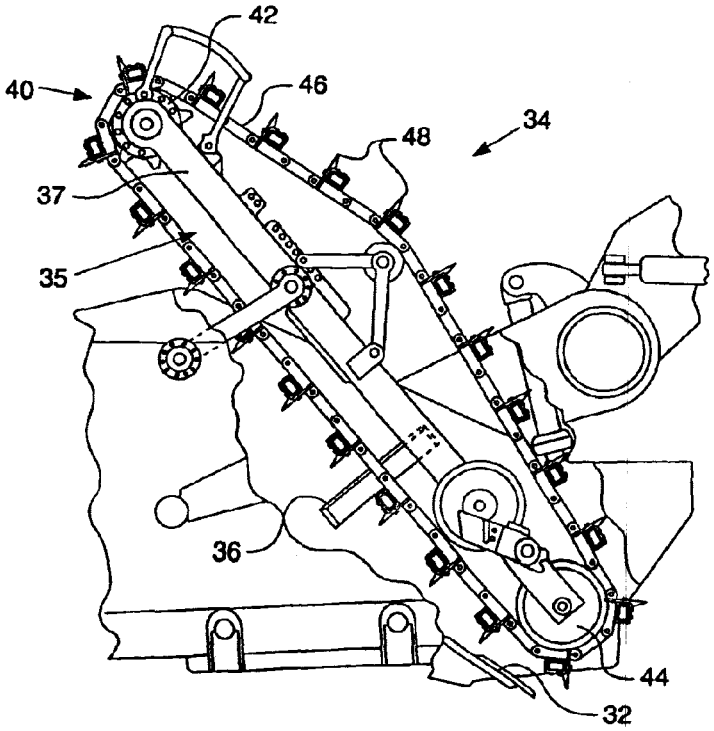
Figure 3:
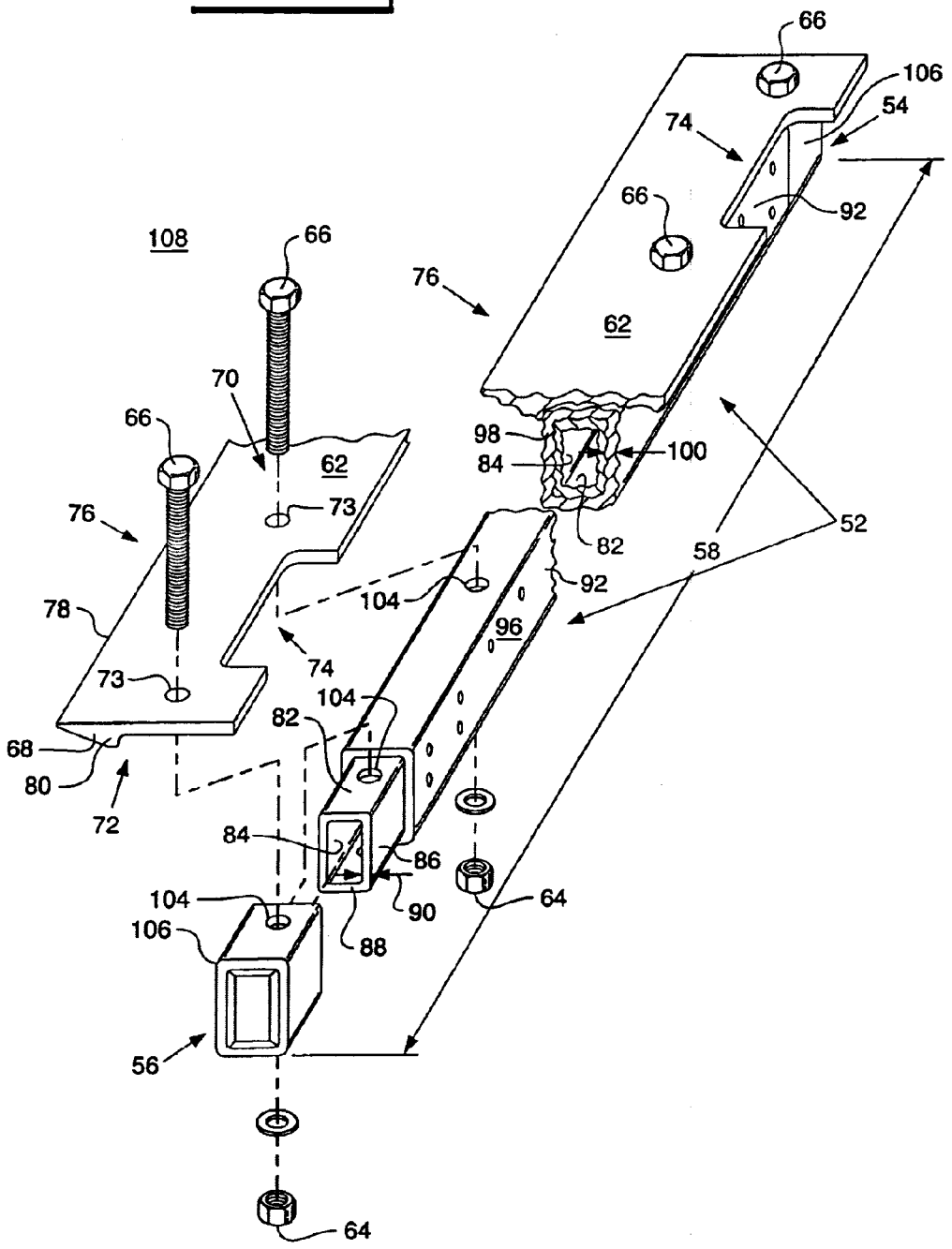

As shown in FIG. 3, the flight assembly 48 for use on an elevator scraper 10 is illustrated. The flight assembly 48 includes a lateral support member 52 having a first end 54 and a second end 56. A length is defined between the first and second ends 54, 56. The length 58 being enough to extend from the first side rail 37 to the second side rail. A wear plate 62 is mechanically attached to the lateral support member, preferably by using a plurality of nuts 64 and bolts 66.

The wear plate 62 preferably has a substantially "half arrow" shaped cross section 68, although a flat plate may be used. The wear plate 62 includes a first side 70 and a second side 72. A pattern of bores 73 extend from the first side 70 to the second side 72. A pair of notches 74 are disposed on the wear plate 62. The notches 74 are configured to permit the lateral support member 52 to engage the endless chains 46. A leading edge 76 is defined on the wear plate 62. As the endless chains 46 and flight assemblies 48 rotate about the vertical frame 35, the leading edge 76 engages the dirt entering the bowl 14. Abrasion causes the leading edge 76 to wear from a point 78 toward a thicker portion 80 of the half arrow cross section 68.

The lateral support member 52 may be provided in numerous forms, such as a structural beam or channel (neither shown). In one exemplary embodiment, the lateral support member 52 includes a pair of inner structural tubes 82. The inner structural tubes 82 have a substantially rectangular cross section having an interior surface 84 and an exterior surface 86. A wall 88 having a predetermined thickness 90 is defined between the inner and outer surfaces 84, 86. An outer structural tube 92 is positioned over the inner structural tube 82. The outer structural tube 92 is substantially rectangular in cross section and includes an inner surface and an outer surface 96. An outer tube wall 98 having a predetermined thickness 100 is defined between the inner surface and the outer surface 96. The inner structural tubes 82 are positioned and attached inside each end of the outer structural tube 92. The inner structural tubes 82 are adapted to slide inside of the outer structural tube 92. A plurality of bores 104 are disposed on each of the structural tubes 82, 92 in a manner that the bores 104 of the inner tubes 82 align with the bores 104 of the outer structural tube 92. Each inner structural tube 82 extends beyond the end of the outer structural tube 92. The plurality of bores 104 additionally is configured to match the pattern of bores 73 of the wear plate 62. An angle member 105 is attached to the lateral support member 52 in a manner to support the wear plate 62.

A wear cap 106 is provided at each end of the lateral support member 52 to fit over each end of the inner structural tubes 82. The wear caps 106 are removably attached to the lateral support member 52. The wear caps 106 may be made of a wear resistant material or may include a wear resistant coating.

INDUSTRIAL APPLICABILITY

In operation a scraper 10 employing the flight assembly 48 of the present invention is assembled in substantially the same manner as a scraper having welded flights. When the flight assemblies 48 begin to show wear patterns on the wear caps 106 or wear plate 62, the worn pieces can be unbolted and replaced without welding or removing the flight from the elevator.

What is claimed is:

1. A flight assembly for use on a scraper elevator, the flight assembly comprising:

an elongated lateral support member having a first end and a second end opposite the first end in a longitudinal direction, the lateral support member being configured to be attached to a pair of endless chains of the elevator whereby a first endless chain is attached at the first end of the lateral support member and a second endless chain is attached at the second end of the lateral support member;

at least one elongated wear plate removably attached to the lateral support member by at least one fastener, the at least one elongated wear plate having a longitudinal direction generally aligned with the longitudinal direction of the lateral support member, the at least one elongated wear plate comprising a leading edge which is configured to engage material entering a scraper bowl and lifts the material upward.

2. The flight assembly of claim 1 further comprising a first and second wear cap removably attached to each of the first and second ends respectively of the lateral support member.

3. The flight assembly of claim 2, wherein the first and second wear caps comprise a wear resistant coating.

4. The flight assembly of claim 1, wherein said wear plate has a half arrow shaped cross section.

5. The flight assembly of claim 1, wherein the at least one elongated wear plate comprises a wear resistant coating applied to the leading edge.

6. The flight assembly of claim 1 wherein:

the at least one elongated wear plate is essentially flat and planar and comprises a top side surface and a bottom side surface, the at least one elongated wear plate contacting the lateral support member at the bottom side surface.

7. The flight assembly of claim 6 wherein:

the leading edge is sharpened.

8. The flight assembly of claim 6 wherein:

the at least one elongated wear plate further comprises a plurality of bores extending from the top side surface to the bottom side surface for accepting a plurality of fasteners which removably attach the at least one elongated wear plate to the lateral support member.

9. The flight assembly of claim 8 wherein:

the at least one elongated wear plate further comprises at least one notch on a back edge which is opposite the leading edge, the notch positioned to at least partially fit around the first or the second endless chain of the elevator.

10. The flight assembly of claim 1 wherein:

the at least one elongated wear plate is essentially flat and planar and comprises a top side surface and a bottom side surface, the at least one elongated wear plate contacting the lateral support member at the bottom side surface.

11. The flight assembly of claim 10 wherein the at least one elongated wear plate is arranged such that the leading edge is generally parallel to the lateral support member and the leading edge extends generally entirely along the length of the lateral support member.

12. The flight assembly of claim 11 wherein the at least one elongated wear plate is positioned such that a back edge which is opposite the leading edge is closer to the pair of endless chains than the leading edge.

13. The flight assembly of claim 12 wherein the at least one flight assembly is positioned such that the at least one elongated wear plate extends out from the pair of endless chains at approximately a right angle.

14. The flight assembly of claim 10 wherein:

the at least one elongated wear plate further comprises a plurality of bores extending from the top side surface to the bottom side surface for accepting a plurality of fasteners which removably attach the at least one elongated wear plate to the lateral support member.

15. The flight assembly of claim 10 wherein:

a leading edge of the at least one elongated wear plate is sharpened.

16. The flight assembly of claim 15 wherein:

the at least one elongated wear plate further comprises at least one notch on a back edge which is opposite the leading edge, the notch positioned to at least partially fit around the first or the second endless chain of the elevator.

17. A scraper having an elevator adapted to move material about a work site, the scraper comprising:

a bowl adapted to be towed about the work site, the elevator positioned in the bowl and comprising a pair of endless chains;

a plurality of flight assemblies attached to the endless chains, wherein at least one of the flight assemblies comprises a lateral support member attached to the pair of endless chains of the elevator and a wear plate removably attached to the lateral support member by at least one fastener, wherein the wear plate has a leading edge which engages material entering said bowl and lifts the material upward.

18. The scraper of claim 17, including a pair of wear caps, the wear caps being removably attached to, respectively, each of a first and second end of the lateral support member.

19. The scraper of claim 18, wherein the wear cap includes a wear resistant coating.

20. The scraper of claim 17, wherein the wear plate includes a half arrow shaped cross section.

21. The scraper of claim 17, wherein the wear plate includes a wear resistant coating applied to the leading edge.

22. A flight assembly for use on a scraper elevator, said flight assembly comprising:

an elongated lateral support member having a first end and a second end opposite the first end in a longitudinal direction, the lateral support member being configured to be attached to a pair of endless chains of the elevator whereby one endless chain is attached at the first end and one endless chain is attached at the second end;

an edge attached to the lateral support member adapted for engaging material entering a scraper bowl and lifting the material upward; and a first wear cap removably attached to the first end of the elongated lateral support member, the first wear cap covering at least a portion of the first end of the elongated lateral support member to protect it from wear.

23. The flight assembly of claim 22 further comprising:

an elongated wear plate removably attached to the lateral support member by at least one fastener, the wear plate comprising the edge which is adapted to engage material entering a scraper bowl and lift the material upward.

24. The flight assembly of claim 23 further comprising:

a second wear cap removably attached to the second end of the elongated lateral support member, the second wear cap covering at least a portion of the second end of the elongated lateral support member to protect it from wear.

25. The flight assembly of claim 22 further comprising:

a second wear cap removably attached to the second end of the elongated lateral support member, the second wear cap covering at least a portion of the second end of the elongated lateral support member to protect it from wear.

* * * * *

UNITED STATES PATENT AND TRADEMARK OFFICE

CERTIFICATE OF CORRECTION

PATENT NO. : 6,857,208 B2
DATED : February 22, 2005
INVENTOR(S) : Smita Gandhi et al.

It is certified that error appears in the above-identified patent and that said Letters Patent is hereby corrected as shown below:

The title page, showing the illustrative figures, should be deleted to be replaced with the attached title page.

The drawing sheet, consisting of Figs. 1-3, should be deleted to be replaced with drawing sheet, consisting of Figs. 1-3, as shown on the attached pages.

Signed and Sealed this

Thirteenth Day of June, 2006

JON W. DUDAS
*Director of the United States Patent and Trademark Office*

(12) United States Patent
Gandhi et al.

(10) Patent No.: US 6,857,208 B2
(45) Date of Patent: Feb. 22, 2005

(54) REBUILDABLE ELEVATOR FLIGHT FOR SCRAPER

(75) Inventors: Smita Gandhi, Peoria, IL (US); Paul J. Lukavich, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/319,787

(22) Filed: Dec. 13, 2002

(65) Prior Publication Data

US 2004/0111926 A1 Jun. 17, 2004

(51) Int. Cl.[7] ..... E02F 3/14; E02F 9/28

(52) U.S. Cl. ..... 37/465

(58) Field of Search ..... 37/422–424, 463–465, 37/373–376, 419, 208, 389, 106, 107

(56) References Cited

U.S. PATENT DOCUMENTS

| | | | |
|---|---|---|---|
| 3,581,415 | A | 6/1971 | Campbell et al. |
| 3,593,439 | A | 7/1971 | Eftefield |
| 3,596,383 | A | 8/1971 | Bispo et al. |
| 3,653,132 | A | 4/1972 | Campbell et al. |
| 3,699,820 | A | 10/1972 | Voth |
| 3,700,383 | A | 10/1972 | Boersma |
| 3,733,964 | A | 5/1973 | Schantz |
| 3,735,509 | A | 5/1973 | Condra |
| 3,748,759 | A | 7/1973 | Liess |
| 3,758,966 | A | 9/1973 | Miller |
| 3,807,063 | A | 4/1974 | Hyler et al. |
| 3,818,618 | A | 6/1974 | Hyler |
| 3,866,742 | A | 2/1975 | Freese et al. |
| 3,872,612 | A | 3/1975 | Gee |
| 3,875,690 | A | 4/1975 | Hancock et al. |
| 3,900,977 | A | 8/1975 | Hyler |
| 3,903,623 | A | 9/1975 | Hyler |
| 3,905,136 | A | 9/1975 | Hyler |
| 3,916,541 | A | 11/1975 | Hood et al. |
| 3,916,545 | A | 11/1975 | Hochmann et al. |
| 3,927,759 | A | 12/1975 | Hyler et al. |
| 3,930,323 | A | 1/1976 | Marold et al. |
| 3,934,360 | A | 1/1976 | Hyler |
| 3,934,362 | A | 1/1976 | Hyler |
| 3,946,619 | A | 3/1976 | Needles et al. |
| 3,946,859 | A | 3/1976 | Jeffrey et al. |
| 3,950,866 | A | 4/1976 | Hyler |
| 3,959,896 | A | 6/1976 | Wagner |
| 3,971,146 | A | 7/1976 | Hyler |
| 3,971,147 | A | 7/1976 | Hyler |
| 3,977,100 | A | 8/1976 | Boersma |

(List continued on next page.)

OTHER PUBLICATIONS

Caterpillar 623G Elevating Scraper Specifications, brochure No. AEHQ5530, Caterpillar Inc., 20 pages, Aug. 2003.

*Primary Examiner*—Christopher J. Novosad
(74) *Attorney, Agent, or Firm*—Thomas L Derry; Andrew J Ririe

(57) ABSTRACT

The present invention provides a flight assembly for use on a scraper having an elevator. The flight assembly includes a lateral support member having a wear plate attached thereon. A wear cap is provided on each end of the lateral support member. The wear plates and wear caps are preferably bolted to the support member.

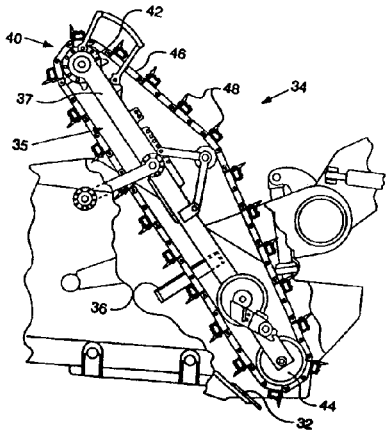

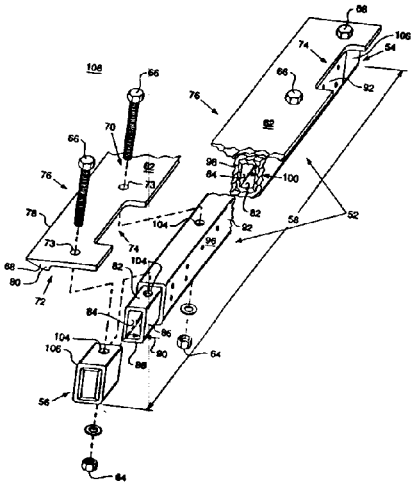

25 Claims, 2 Drawing Sheets